United States Patent [19]

Shigemori

[11] 4,243,334

[45] Jan. 6, 1981

[54] RIBBON CARTRIDGE

[75] Inventor: Youjiro Shigemori, Shizuoka, Japan

[73] Assignee: Star Seimitsu Kabushiki Kaisha, Japan

[21] Appl. No.: 937,993

[22] Filed: Aug. 30, 1978

[51] Int. Cl.[3] ..... B41J 33/36

[52] U.S. Cl. ..... 400/247; 400/241.4; 400/234

[58] Field of Search ..... 400/241.4, 247, 234, 400/204, 206.4, 196.1, 210, 194, 206, 206.3, 248, 697, 697.1; 101/336

[56] References Cited

U.S. PATENT DOCUMENTS

| | | | |
|---|---|---|---|
| 2,699,244 | 1/1955 | Markes | 400/241.4 |
| 2,849,096 | 8/1958 | Markes | 400/241.4 |
| 3,610,140 | 10/1971 | Kondur | 400/247 X |
| 3,904,017 | 9/1975 | Frechette | 400/196.1 |
| 3,960,259 | 6/1976 | Guerrini et al. | 400/234 X |
| 3,989,132 | 11/1976 | Carson | 400/234 X |

*Primary Examiner*—Edward M. Coven

*Attorney, Agent, or Firm*—Robert E. Burns; Emmanuel J. Lobato; Bruce L. Adams

[57] ABSTRACT

A ribbon cartridge comprising a housing including a first cavity in which an ink ribbon in the form of an endless loop is received in irregular form, and a second cavity in which a tape in the form of an endless loop of high polymer film or metal film and having a width which is substantially equal to that of the ribbon is received in irregular form. The housing has an inlet and an outlet, which are common to both the ribbon and the tape and which communicate with both the first and second cavities. Either the ribbon or tape is drawn to the outside of the housing through the common outlet from their associated cavity and is then again inserted into the corresponding cavity through the common inlet. Intermediate the inlet and the outlet, both the ribbon and the tape are maintained in substantially overlapping relationship so as to be subject to the action of a printing element. The common inlet is provided with at least one set of pinch rollers for driving the ribbon and the tape into their associated cavities while the common outlet is provided with known friction means which delay the movement of the ribbon and the tape out of their associated cavity.

5 Claims, 3 Drawing Figures

RIBBON CARTRIDGE

FIELD AND BACKGROUND OF THE INVENTION

The invention relates to an ink ribbon cartridge for a high speed printer of the impact type of for a typewriter.

A wire printer is well known in the art which includes a plurality of wires which are selectively movable in their axial direction. For a printer of this type, it is necessary to guide the wires at a location which is as near to a printing surface as possible in order assure a reliable control of the reciprocating motion of the thin wires. However, there is a tendency for the ink to flow along the wire from the type-carrying end of the wire to produce a substantial amount of friction between such guide means and the wire. Such friction makes it difficult to drive the wires at a given rating, and also unnecessarily increases the clearance between the wire and guide means. On the other hand, in a high speed printer of the impact type having a type wheel or in an ordinary typewriter, there occurs a deposition of ink on the type, which contaminates the type to obscure the characters being typed.

DESCRIPTION OF THE PRIOR ART

Efforts are directed to the elimination of difficulties caused by ink transferred from a ribbon to a printing element such as wires or type, principally in two aspects. A print head including means which prevents a flow of the ink along the wire from the type-carrying end thereof is disclosed, for example, in U.S, Pat. Nos. 2,928,338 and 3,302,562, and French Patent Application No. 6944089. However, in these arrangements, the print heads have a complex construction and require a troublesome maintenance.

An ink ribbon formed by a high polymer film such as polyester or polyamide and carrying ink only on its one side in order to prevent the deposition of ink on a printing element is disclosed in West German Patent Publications No. 1,204,245 and No. 2,453,674. A ribbon is also known which comprises an ink containing fabric strip, on one side of which a heat fusible plastic film is applied.

A ribbon cartridge including a ribbon in the form of an endless loop which is received in irregular form within a housing is disclosed in U.S. Pat. No. 3,974,906. The housing is provided with a ribbon outlet and inlet, and a length of non-supported ribbon extends between the inlet and the outlet. The inlet is provided with a set of pinch rollers which drives the ribbon into the housing while the outlet is provided with friction means which delays the movement of the ribbon as it leaves the outlet.

SUMMARY OF THE INVENTION

It is an object of the invention to provide a ribbon cartridge including a contamination preventing film which is separate from an ink ribbon and which prevents direct contact of a printing element with the ink ribbon.

In accordance with the invention, there is provided a ribbon cartridge comprising a housing including a first cavity in which an ink ribbon in the form of an endless loop is received in irregular form, and a second cavity in which a tape in the form of an endless loop of high polymer film or metal film and having a width which is substantially equal to that of the ribbon is received in irregular form. The housing has an inlet and an outlet, which are common to both the ribbon and the tape and which communicate with both the first and second cavities. Either the ribbon or tape is drawn to the outside of the housing through the common outlet from their associated cavity and is then again inserted into the corresponding cavity through the common inlet. Intermediate the inlet and the outlet, both the ribbon and the tape are maintained in substantially overlapping relationship so as to be subject to the action of a printing element. The common inlet is provided with at least one set of pinch rollers for driving the ribbon and the tape into their associated cavities while the common outlet is provided with known friction means which delay the movement of the ribbon and the tape out of their associated caivty.

According to the invention, the printing element drives the ribbon into contact with the printing surface through the tape interposed therebetween, thus avoiding a contamination of the printing element by the ink. Since the ribbon and the tape are guided in substantially overlapping relationship without being adhesively secured together, it is possible to avoid excessive amount of trace which might result from differential distortions of these members upon impact by the printing element.

In a preferred embodiment of the invention, the ribbon is formed by a web of a cloth or textile fabric which is impregnated with ink. The tape comprises a polyester or polyamide film.

DETAILED DESCRIPTION OF THE INVENTION

Figure 1:
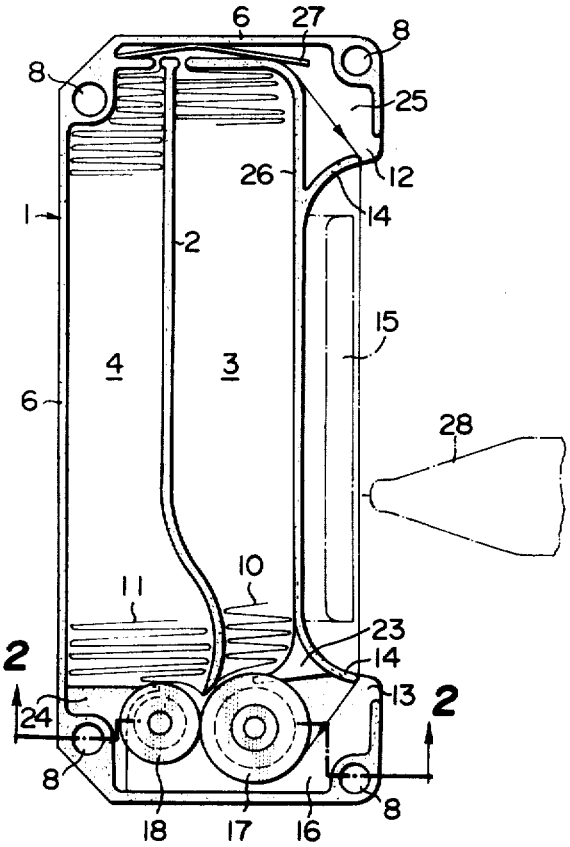
FIG. 1 is a plan view of the ribbon cartridge of the invention, with a top cover being removed.
Figure 2:
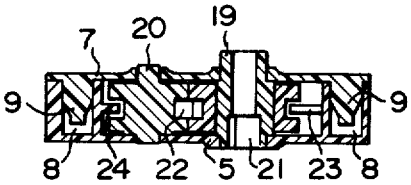
FIG. 2 is a cross section taken along the line 2-2 shown in FIG. 1.

Referring to FIG. 1, the ribbon cartridge according to the invention comprises housing 1 including a partition 2 which divides the interior of the housing into first cavity or compartment 3 and second cavity 4. Housing 1 includes bottom wall 5, sidewalls 6, and top cover 7 having a plurality of pins 9 which frictionally engage openings 8 formed in sidewall 6 (see FIG. 2). Ink ribbon 10 in irregular form is received in the first cavity 3 while tape 11 which may comprise a high polymer film or metal film is similarly received in irregular form within the second cavity 4. Both ribbon 10 and tape 11 extend through common outlet 12 of housing 1 for subsequently entering respective associated cavities. In order to maintain a clearance between the housing and ribbon 10 and tape 11 outside thereof, housing 1 is provided with a pair of spaced guide members 14. When guided across guide members 14 outside of housing 1, the ribbon and tape are maintained in overlapping relationship and are located between a platen 15 and a print element or print heat 28. A paper on which characters are to be printed is situated between platen 15 and the outer run of the ribbon.

Relatively wide inlet passageway 16 extends between common inlet 13 and respective cavities 3, 4, and a pair of rollers 17, 18 are disposed in this passageway for feeding ribbon 10 and tape 11 into their associated cavities. Rollers 17, 18 are mounted on shafts 19, 20 which extend between and are rotatably supported by bottom plate 5 and top cover 7. Shaft 19 is provided with a star-shaped coupling which may be connected with a drive shaft provided on the part of a printer or typewriter. Rollers 19, 20 are peripherally formed with annular grooves 22 into which extend respective arms 23, 24 which prevent the ribbon 10 or tape 11 from being excessively wound around the surface of the respective rollers. Arms 23, 24 project laterally from sidewall 6. An outlet passageway 25 extends between respective cavities 3, 4 and common outlet 12, and is defined by one of the sidewalls 6 and inner wall 26. Leaf spring 27 is disposed within passageway 25 for resiliently engaging the surface of inner wall 26. Leaf spring 27 operates to urge ribbon 10 and tape 11 against the inner wall 26 as they move through passageway 25 toward common outlet 12, thus delaying their movement out of the associated cavities 3, 4.

In operation, when ribbon 10 and tape 11 are taken out of the respective cavities through common outlet 12 to the outside of housing 11, they are fed over guide members 14 in overlapping and face-to-face contacting relationship to common inlet 13 to be delivered to roller 17, which rotates to feed them into the nip between rollers 17, 18, thus returning them into the associated cavities 3, 4 again. It will be seen that the braking action by leaf spring 17, located adjacent to the outlet, maintains both ribbon 10 and tape 11 taut and in overlapping and directly contacting relationship across the pair of guide members 14, thus allowing the movement of the print element to be faithfully transmitted to ribbon 10 through the interposed tape 11. In particular, it should be noted that the occurrence of a distortion which results from differential elastic deformations of ribbon 10 and tape 11 in response to an impact by the print, such element as may be experienced in the conventional lined ink ribbon, can be effectively prevented.

Figure 3:
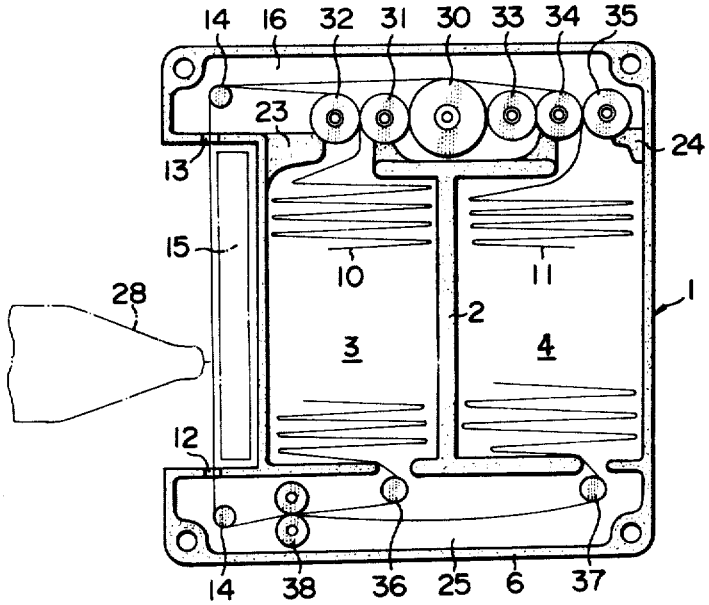
FIG. 3 is a plan view similar to FIG. 1, showing another embodiment of the Invention.

FIG. 3 shows another embodiment of the invention where corresponding parts are designated by like numerals. The pair of guide members 14 comprise pins disposed within inlet passageway 16 and outlet passageway 25, respectively. The part of ribbon 10 and tape 11 extending across guide pins 14 is adapted to cooperate with a printer mechanism. A set of rollers are disposed within inlet passageway 16 for feeding the ribbon 10 and tape 11 from guide pin 14 into their associated cavities 3, 4. The set of rollers includes drive roller 30, a pair of pinch rollers 31, 32, idler 33, and another pair of pinch rollers 34, 35. Drive roller 30 is provided with a star-shaped coupling (not shown) which is similar to that mentioned in connection with the preceding embodiment, and drives the pair of pinch rollers 31, 32 and also drives the other pair of pinch rollers 34, 35 through idler 33. The roller pair 31, 32 feeds the ribbon 10 into cavity 3, while the roller pair 34, 35 feeds the tape 11 into cavity 4. As before, the respective roller pairs 31, 32 and 34, 35 coact with arms 23, 24 which serve the same purpose as mentioned previously. Disposed within outlet passageway 25 are guide pin 36 associated with ribbon 10 and another guide pin 37 associated with tape 11 as well as a pair of back tension rollers 38 which guide ribbon 10 and tape 11 passing around these guide pins to the initially mentioned guide members 14 while applying a braking action to them.

What is claimed is:

1. A ribbon cartridge comprising: an ink ribbon in the form of an endless loop; an endless tape loop having substantially the same width as the ribbon and formed as a film; a housing including a first cavity and a second cavity which receive the ribbon and the tape, respectively, both cavities being located on the same plane, the housing being formed with a common outlet and a common inlet for both the ribbon and the tape, an outlet passageway for connecting one end of the respective cavities with the common outlet, and an inlet passageway for connecting the other end of the cavities with the common inlet; a pair of guide members for guiding the ribbon and tape across the common outlet and the common inlet in spaced relationship from the housing; a set of rollers disposed within the inlet passageway for receiving the ribbon and the tape from one of the guide members and feeding them into their associated cavities; and friction means disposed in the outlet passageway for feeding the ribbon and the tape to the other guide member from the respective cavities while applying a braking action thereto; said guide members, rollers and friction means coacting to maintain the ribbon and tape in overlapping and face-to-face contacting relationship when the ribbon and tape are between the pair of guide members.

2. A ribbon cartridge according to claim 1 in which the set of rollers include a drive roller having a coupling for operative connection with a drive shaft located outwardly of the housing, and a pinch roller disposed for contact with the drive roller.

3. A ribbon cartridge according to claim 1 in which the set of rollers includes a drive roller, a pair of pinch rollers disposed for engagement with the drive roller and receiving therebetween the ribbon, an idler disposed for contact with the drive roller, and another pair of pinch rollers driven by the drive roller through the idler and receiving therebetween the tape.

4. A ribbon cartridge according to claim 1 in which the tape comprises a high polymer film.

5. A ribbon cartridge according to claim 1 in which the tape comprises a metal film.

* * * * *